US011385026B2

(12) United States Patent
Roberson

(10) Patent No.: US 11,385,026 B2
(45) Date of Patent: Jul. 12, 2022

(54) FLASHLIGHT MOUNT FOR A FIREARM

(71) Applicant: Arisaka LLC, Apex, NC (US)

(72) Inventor: William Roberson, Apex, NC (US)

(73) Assignee: ARISAKA LLC, Apex, NC (US)

( * ) Notice: Subject to any disclaimer, the term of this patent is extended or adjusted under 35 U.S.C. 154(b) by 0 days.

(21) Appl. No.: 17/176,289

(22) Filed: Feb. 16, 2021

(65) Prior Publication Data

US 2021/0262766 A1 Aug. 26, 2021

Related U.S. Application Data

(60) Provisional application No. 62/979,648, filed on Feb. 21, 2020.

(51) Int. Cl.

| | |
|---|---|
| ***F41A 11/00*** | (2006.01) |
| ***F41G 11/00*** | (2006.01) |
| *F41G 1/35* | (2006.01) |

(52) U.S. Cl.

CPC ..... *F41G 11/001* (2013.01); *F41G 1/35* (2013.01)

(58) Field of Classification Search

CPC ..... F41G 1/387; F41G 11/003

See application file for complete search history.

(56) References Cited

U.S. PATENT DOCUMENTS 2,769,895 A * 11/1956 Boord ..... F41G 11/004 248/229.24
3,106,348 A * 10/1963 Robinson ..... F41G 1/35 248/224.7
4,348,716 A * 9/1982 Storm ..... F41G 1/35 362/202
5,606,818 A * 3/1997 Hardee ..... F41G 11/003 42/124
7,134,234 B1 * 11/2006 Makarounis ..... F41G 11/004 42/114
7,908,782 B1 * 3/2011 LaRue ..... F41G 11/008 42/124
D659,221 S * 5/2012 Wu ..... D22/108
D663,006 S * 7/2012 Storch ..... D22/108
8,726,562 B1 * 5/2014 Hoskisson ..... F41G 11/003 42/135
8,769,859 B2 * 7/2014 Li ..... F41G 11/003 42/124
RE45,724 E * 10/2015 Dueck ..... F41G 1/26
D747,780 S * 1/2016 Swan ..... D22/110
9,441,915 B2 * 9/2016 Zimmer ..... F41G 11/004
9,506,723 B2 * 11/2016 Teetzel ..... F41G 1/473
D780,278 S * 2/2017 Pittman ..... D22/108
9,562,550 B2 * 2/2017 Swan ..... F41G 11/003
D806,199 S * 12/2017 Roberson ..... D22/108
(Continued)

*Primary Examiner* — Joshua E Freeman

(74) *Attorney, Agent, or Firm* — Asgaard Patent Services, LLC; F. Wayne Thompson, Jr.

(57) ABSTRACT

Disclosed is a flashlight mount configured to attach a flashlight to the handguard of a firearm, in particular a rifle. An example flashlight mount comprises a base configured to be removably coupled to a handguard of a firearm; and an extension that includes an accessory interface configured to provide multiple lateral mounting positions for a flashlight. The accessory interface comprises two parallel rows of overlapping holes. Each of the two parallel rows of overlapping holes includes at least two overlapping holes aligned linearly with each other, each of the overlapping holes includes a tapered inlet.

11 Claims, 5 Drawing Sheets

(56) References Cited

U.S. PATENT DOCUMENTS

| | | | | |
|---|---|---|---|---|
| 10,030,935 | B1 * | 7/2018 | Ding | F41G 1/01 |
| 10,184,756 | B1 * | 1/2019 | McCauley | F41G 1/35 |
| 2002/0172034 | A1 * | 11/2002 | Lawless | F41G 11/001 362/205 |
| 2006/0026888 | A1 * | 2/2006 | Cheng | F41G 11/004 42/146 |
| 2008/0205037 | A1 * | 8/2008 | Griffin | F41G 11/003 362/110 |
| 2011/0247255 | A1 * | 10/2011 | Ding | F41G 11/003 42/90 |
| 2012/0060402 | A1 * | 3/2012 | Dueck | F41G 1/26 42/137 |
| 2013/0318848 | A1 * | 12/2013 | Kincel | F41G 11/001 403/322.4 |
| 2014/0003862 | A1 * | 1/2014 | Shi | F41G 11/003 403/322.4 |
| 2015/0285584 | A1 * | 10/2015 | Mayberry | F41G 11/001 42/71.01 |
| 2016/0025120 | A1 * | 1/2016 | Swan | F41G 11/003 24/492 |
| 2016/0320160 | A1 * | 11/2016 | Zimmer | F41G 1/02 |
| 2020/0064102 | A1 * | 2/2020 | Galli | H05B 45/00 |
| 2020/0232761 | A1 * | 7/2020 | Keeney | F41G 11/001 |
| 2021/0055078 | A1 * | 2/2021 | Roberson | F41G 1/387 |

* cited by examiner

FLASHLIGHT MOUNT FOR A FIREARM

CROSS REFERENCE TO RELATED APPLICATION

This application claims the benefit of U.S. Provisional Application Ser. No. 62/979,648, filed on Feb. 21, 2020, the entirety of which is incorporated herein by reference.

TECHNICAL FIELD

This disclosure relates to implementations of a flashlight mount. In particular, the present invention is primarily directed to an accessory mount that can be used to position a flashlight on the handguard of a firearm.

BACKGROUND

Flashlights are routinely used in conjunction with a firearm (e.g., a handgun, a rifle, etc.) to aid in low-light target identification, thereby allowing an operator to simultaneously aim the firearm and illuminate the target. Mounting a flashlight directly to the firearm leaves the operator free to use both hands to operate the weapon. These flashlights are often referred to as weapon mounted lights. Weapon mounted lights are routinely positioned so that any light beam emitted therefrom is parallel to the longitudinal axis of the bore. Most models can be operated by a push-button tailcap switch, a remote tape switch connected thereto by a cable, or a combination thereof.

Ideally, a weapon mounted light is positioned as close as is possible to the handguard of a firearm, without making contact therewith. In particular, it is often desirable for the weapon mounted light to be positioned close to the top of the handguard or the front sight, laser aiming device, or other accessory attached thereto. However, due to the variety of handguard designs or any accessories attached thereto (e.g., front sight, laser aiming device, etc.), optimal placement of a weapon mounted light on the handguard can be difficult.

Accordingly, it can be seen that needs exist for the flashlight mount disclosed herein. It is to the provision of a flashlight mount configured to address these needs, and others, that the present invention is primarily directed.

SUMMARY OF THE INVENTION

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is a flashlight mount configured to attach a flashlight to the handguard of a firearm, in particular a rifle. The exemplary implementation of the flashlight mount can be removably coupled to a handguard having an M-Lok® engagement interface and is configured to place a flashlight secured thereon at a 45-degree angle relative to the M-Lok® engagement interface. While the exemplary implementation of the flashlight mount is configured for attachment to an M-Lok® engagement interface, it should be understood that alternate implementations of the flashlight mount could be configured for attachment to a different firearm accessory engagement interface (e.g., a KeyMod interface or a MIL-STD-1913 rail interface). Further, alternate implementations of the flashlight mount could be configured to place the flashlight at an angle other than 45 degrees relative to the accessory engagement interface to which the flashlight mount is attached.

An example flashlight mount comprises a base configured to be removably coupled to a handguard of a firearm; and an extension that includes an accessory interface configured to provide multiple lateral mounting positions for a flashlight. The accessory interface comprises two parallel rows of overlapping holes. Each of the two parallel rows of overlapping holes includes at least two overlapping holes aligned linearly with each other, each of the overlapping holes includes a tapered inlet.

BRIEF DESCRIPTION OF THE DRAWINGS

Like reference numerals refer to corresponding parts throughout the several views of the drawings.

DETAILED DESCRIPTION

Figure 1:
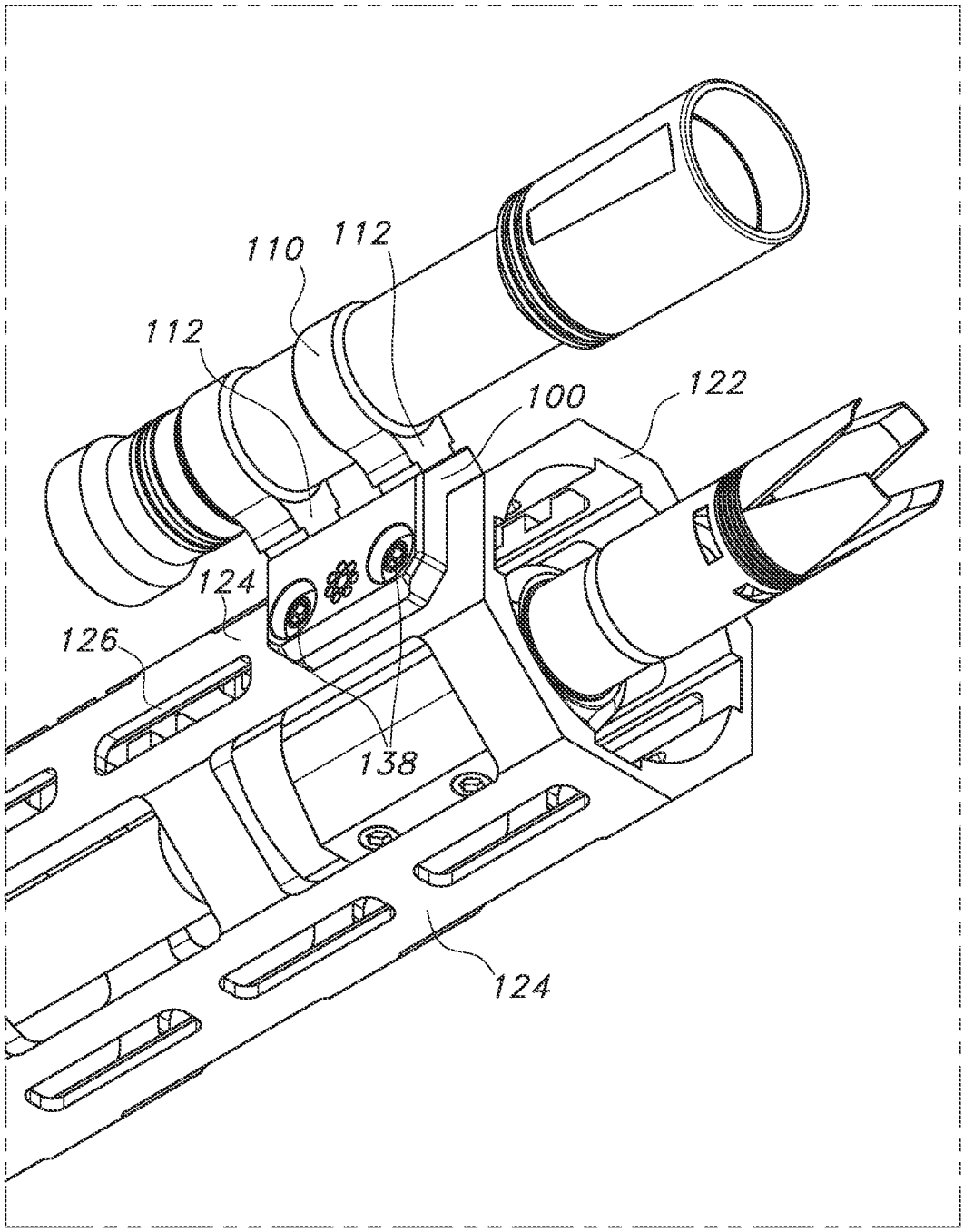
FIG. 1 illustrates an isometric view showing an exemplary implementation of a flashlight mount according to the principles of the present disclosure; the flashlight mount is shown being used to attach a flashlight to the handguard of a firearm.

FIGS. 1-3 and 5-9 illustrate an exemplary implementation of a flashlight mount 100 according to the principles of the present disclosure. As shown in FIG. 1, the flashlight mount 100 is configured to attach a flashlight 110 to the handguard 122 of a firearm 120, in particular a rifle. The exemplary implementation of the flashlight mount 100 can be removably coupled to a handguard 122 having an M-Lok® engagement interface 124 and is configured to place a flashlight 110 secured thereon at a 45-degree angle relative to the M-Lok® engagement interface 124. While the exemplary implementation of the flashlight mount 100 is configured for attachment to an M-Lok® engagement interface 124, it should be understood that an alternate implementation of the flashlight mount 100 could be configured for attachment to a different firearm accessory engagement interface (e.g., a KeyMod interface or a MIL-STD-1913 rail interface). Further, an alternate implementation of the flashlight mount 100 could be configured to place the flashlight at an angle other than 45 degrees relative to the accessory engagement interface 124 to which the flashlight mount 100 is attached.

As shown in FIGS. 5-9, in some implementations, the flashlight mount 100 comprises: a base 130 that can be removably coupled to a handguard 122 of a firearm; and an extension 132 that includes an accessory interface 134 configured to provide multiple lateral mounting positions for a flashlight 110. While the accessory interface 134 of the flashlight mount 100 is shown with three lateral mounting positions for a flashlight 110, it should be understood that an alternate implementation of the flashlight mount 110 could be configured to provide less than three, or more than three, lateral mounting positions.

Figure 8:
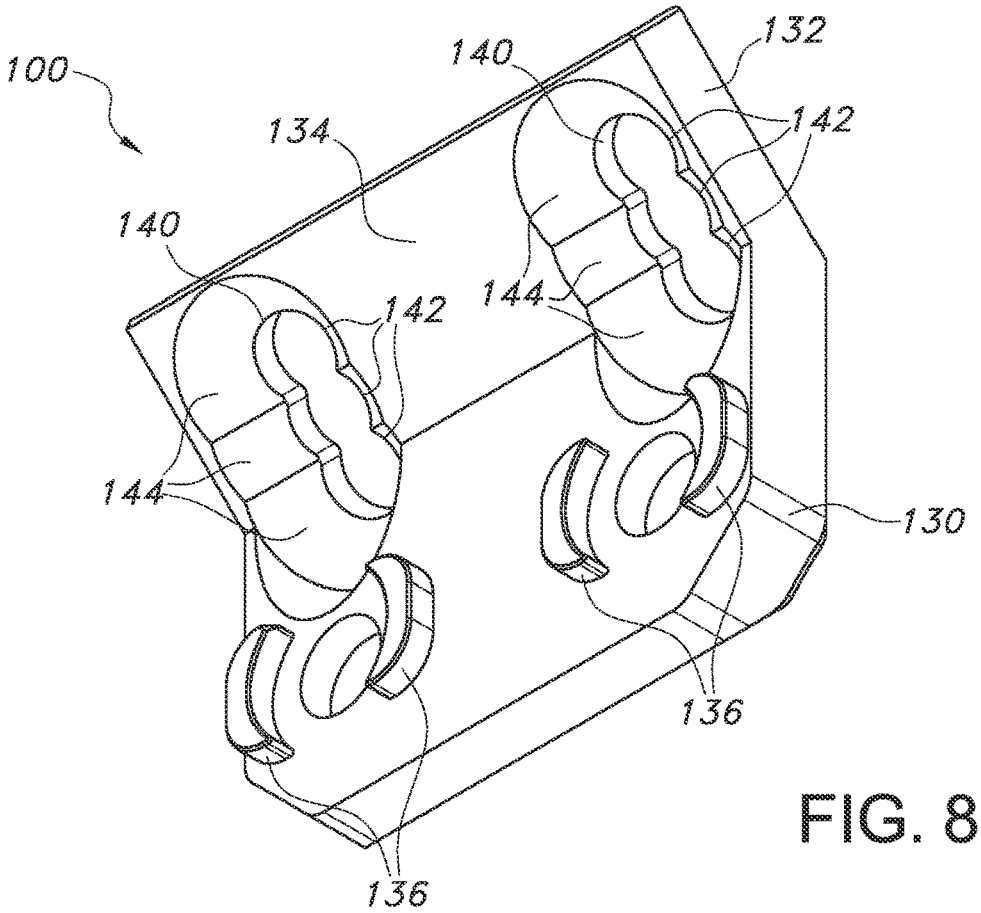
FIG. 8 illustrates another isometric view of the flashlight mount shown in FIG. 5.
Figure 9:
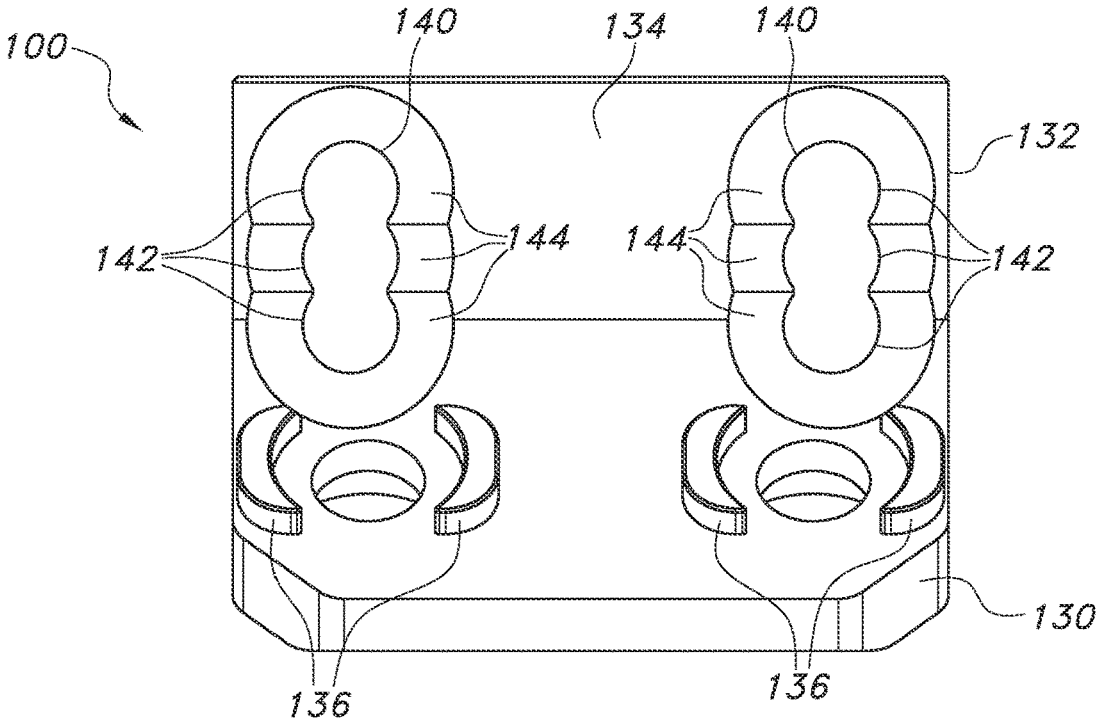
FIG. 9 illustrates a rear view of the flashlight mount shown in FIG. 5.

As shown best in FIGS. 8 and 9, the base 130 includes pairs of protrusions 136 configured to be inserted into elongated slots 126 conforming to the M-LOK standard. The pairs of protrusions 136, in conjunction with suitable sets of fasteners 138 (e.g. a screw and a nut), are used to removably couple the flashlight mount 100 to the M-Lok® engagement interface 124 of the handguard 122 (see, e.g., FIGS. 1 and 2). One of ordinary skill in the art, having the benefit of the present disclosure and without undue experimentation, could make a flashlight mount 100 having a base 130 that can removably couple to an M-Lok® engagement interface 124, or another firearm accessory engagement interface (e.g., a KeyMod interface or a MIL-STD-1913 rail interface).

Figure 6:
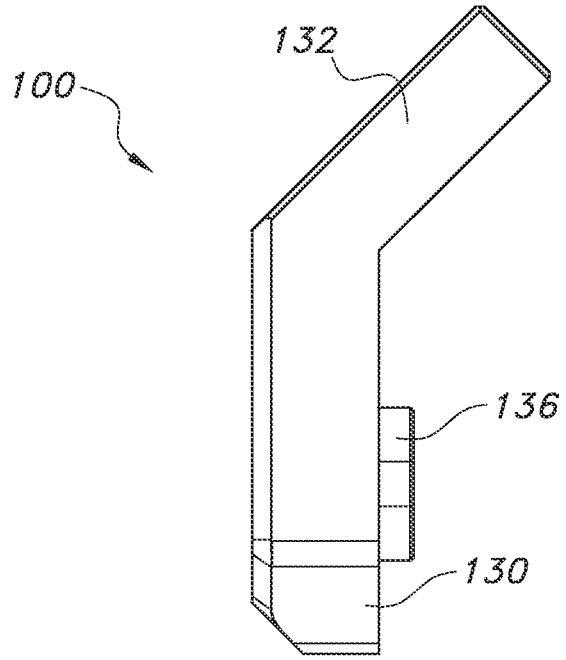
FIG. 6 illustrates a right side view of the flashlight mount shown in FIG. 5.
Figure 7:
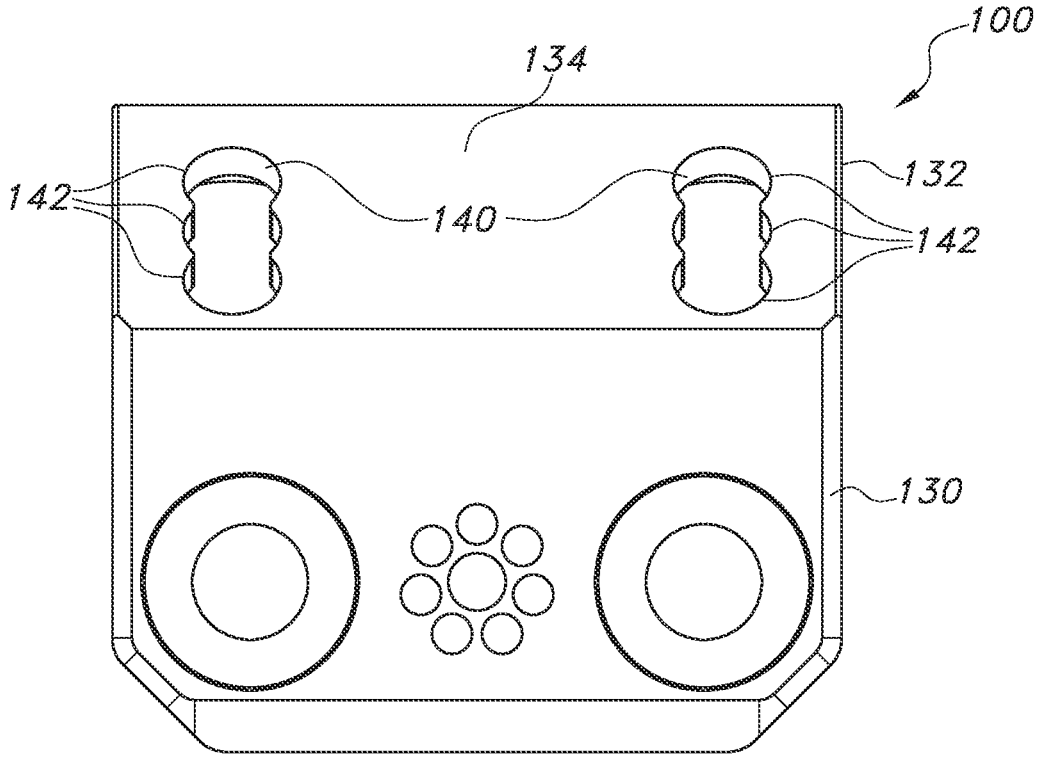
FIG. 7 illustrates a front view of the flashlight mount shown in FIG. 5.

As shown best in FIGS. 1 and 6, the extension 132 is angled 45 degrees relative to the base 130 of the flashlight mount 100. In this way, the flashlight 110 attached to the accessory interface 134 of the extension 132 is positioned at a 45-degree angle, relative to the base 130, while coupled to the handguard 122 by the flashlight mount 100. In some implementations, the extension 132 may be at an angle other than 45 degrees relative to the base 130 of the flashlight mount 100.

As shown best in FIGS. 5 and 7-9, the accessory interface 134 of the extension 132 comprises two parallel rows of overlapping holes 140, each row includes three overlapping holes 142 aligned linearly with each other. In this way, the accessory mounting interface 134 provides three lateral mounting positions for a flashlight 110. Each hole 142 extends through the accessory interface 134 and includes a tapered inlet 144 configured to receive the tapered head 152 of a screw type fastener 150 (see, e.g., FIGS. 2 and 3). The tapered inlet 144 of a hole 138 receives the tapered head 152 of a fastener 150 and thereby prevents the lateral displacement of the fastener 150 within a row of overlapping holes 140 (see, e.g., FIG. 2).

It should be understood that, the lateral mounting positions provided by the two parallel rows of overlapping holes 140 in the accessory interface 134 of the flashlight mount 100 allow the user to laterally adjust the position of an attached flashlight 110 relative to the handguard 122. In this way, the flashlight 110 can be positioned to clear other accessories attached to the handguard.

Figure 2:
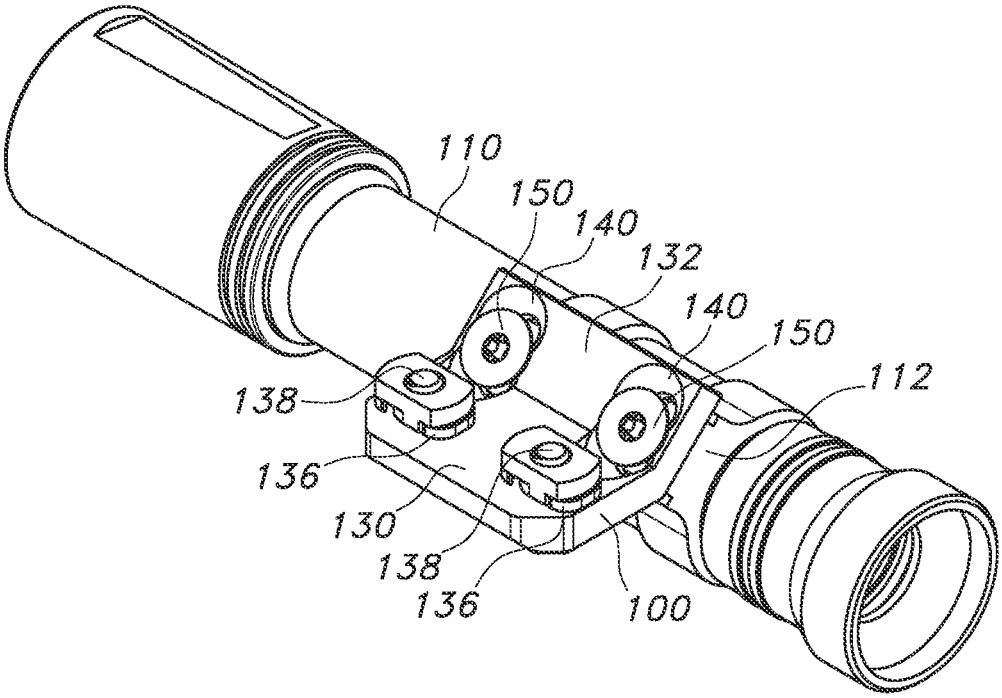
FIG. 2 illustrates an isometric view of the flashlight mount shown in FIG. 1; wherein the flashlight is shown removably coupled to the accessory interface of the flashlight mount by two fasteners.
Figure 3:
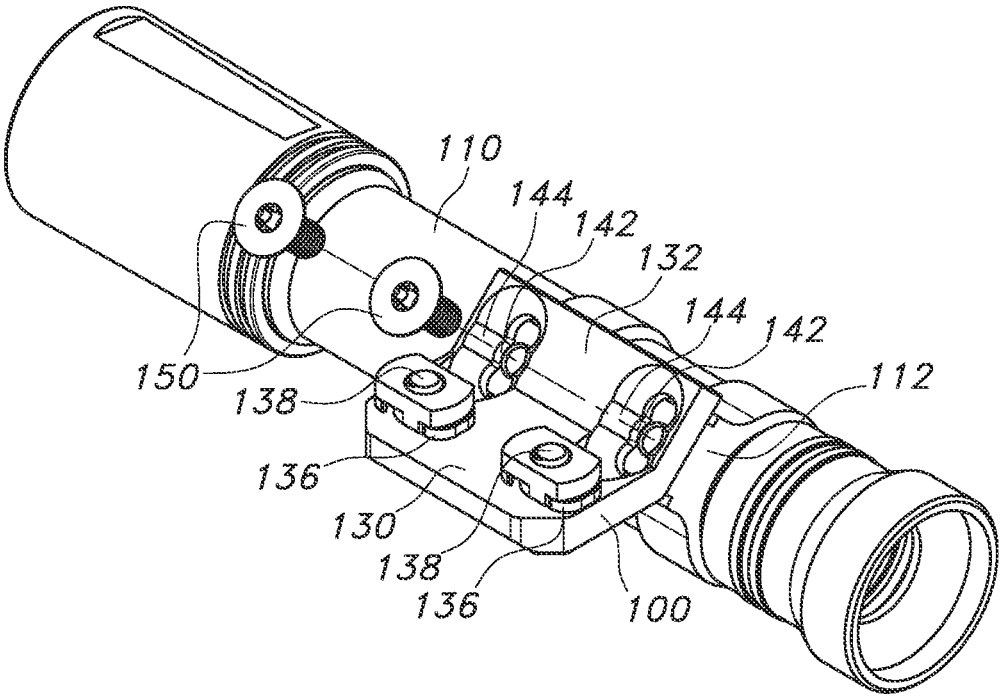
FIG. 3 illustrates another isometric view of the flashlight and flashlight mount shown in FIG. 2; wherein the fasteners are shown exploded from the flashlight and the flashlight mount.
Figure 4:
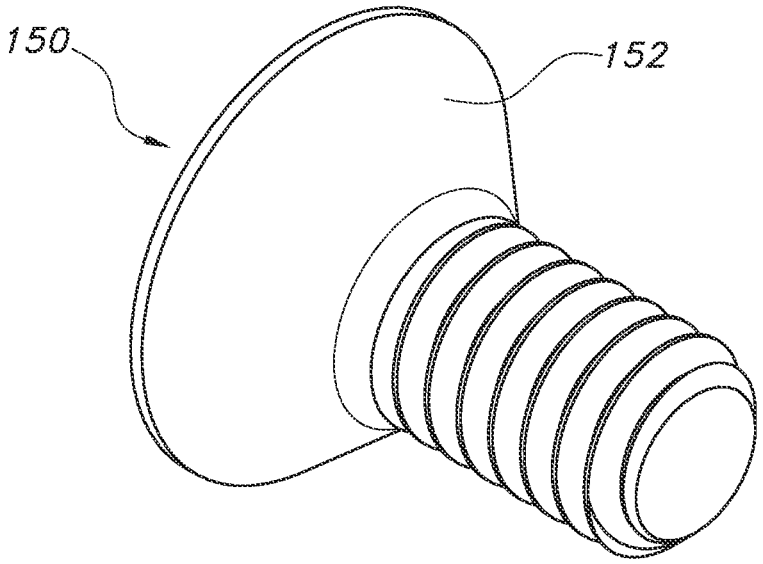
FIG. 4 illustrates an isometric view of an exemplary screw type fastener used to secure the flashlight to the accessory interface of the flashlight mount.
Figure 5:
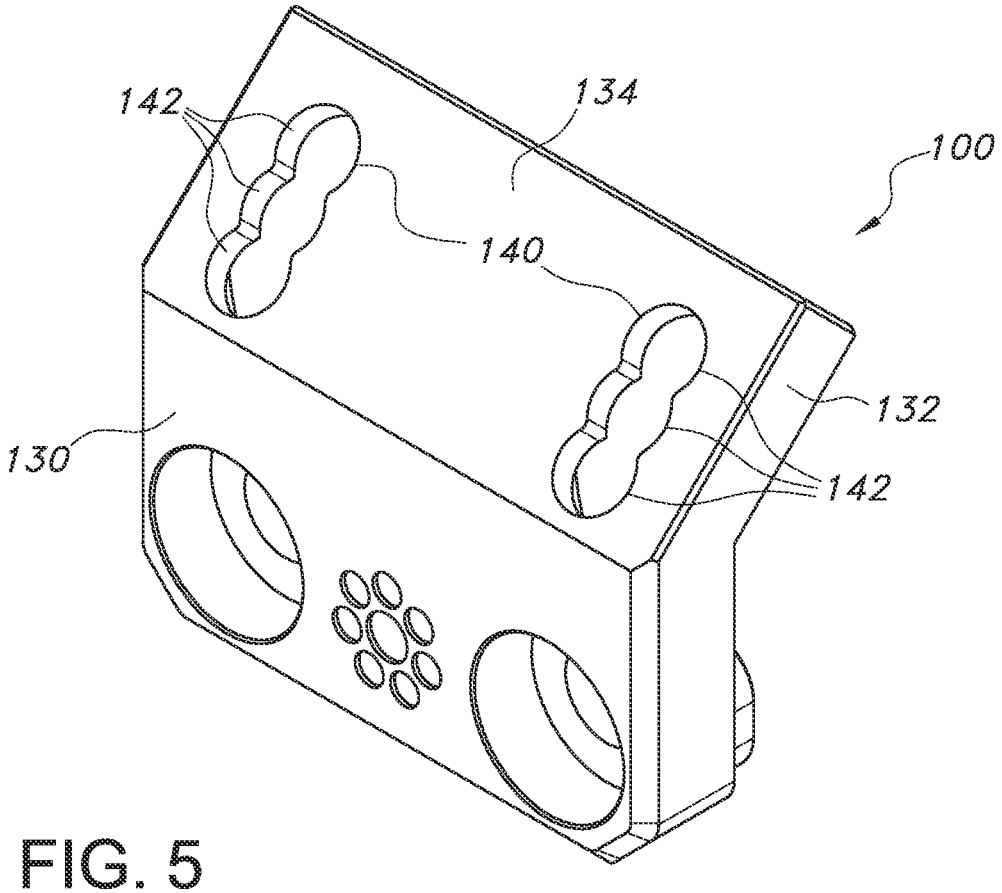
FIG. 5 illustrates an isometric view of the flashlight mount shown in FIG. 1.

As shown in FIGS. 2-4, the tapered head 152 of a screw type fastener 150 is complementary to the tapered inlet 144 of each hole 142 in the accessory interface 134 of the flashlight mount 100. When being used to secure the flashlight 110 to the flashlight mount 100, the tapered head 152 causes the fastener 150 to self-center within the tapered inlet 144 of the receiving hole 142 in the accessory interface 134. Also, the tapered head 152 of the fastener 150 provides an increased surface area that engages with the tapered inlet 144 of the receiving hole 142 and thereby reduces the probability of the fastener 150 coming unscrewed as a result of incidental vibration resulting from the discharge of a firearm to which the flashlight mount 100 is attached. The tapered head 152 of a fastener 150 has a frustoconical shape (see, e.g., FIG. 4).

As shown in FIGS. 6-9, the base 130 and the extension 132 of the flashlight mount 100 are a single unitary piece of machined aluminum. But, in some implementations, the flashlight mount 100 could be manufactured from a suitable polymeric material.

While a flashlight 110 having an Arisaka brand light body is shown in FIGS. 1-3, it should be understood that the flashlight mount 100 can be attached to any flashlight body that includes the same, or similar, mounting lugs 112 (e.g., the body of a Surefire® scout Light®).

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A flash light mount comprising:

a base configured to be removably coupled to a handguard of a firearm; and an extension that includes an accessory interface configured to provide multiple lateral mounting positions for a flash light;

wherein:

the accessory interface comprises two parallel rows of overlapping holes, each of the two parallel rows of overlapping holes includes at least two overlapping holes aligned linearly with each other, each of the overlapping holes includes a tapered inlet.

2. The flashlight mount of claim 1, wherein the extension is at an angle relative to the base.

3. The flashlight mount of claim 1, wherein the base and the extension are a single unitary piece.

4. A flash light mount comprising:

a base that can be removably coupled to a handguard of a firearm; and an extension that includes an accessory interface configured to provide three lateral mounting positions for a flash light;

wherein:

the accessory interface comprises two parallel rows of overlapping holes, each of the two parallel rows of overlapping holes includes three overlapping holes aligned linearly with each other, each of the overlapping holes includes a tapered inlet.

5. The flashlight mount of claim 4, wherein the extension is at an angle relative to the base.

6. The flashlight mount of claim 4, wherein the base and the extension are a single unitary piece.

7. A flash light mount comprising:

a base that can be removably coupled to a handguard of a firearm;

an extension that includes an accessory interface configured to provide three lateral mounting positions fora flashlight; and two threaded fasteners, each of the two threaded fasteners includes a tapered head;

wherein:

the accessory interface comprises two parallel rows of overlapping holes, each of the two parallel rows of overlapping holes includes three overlapping holes aligned linearly with each other, each of the overlapping holes includes a tapered inlet configured to receive the tapered head of one of the two threaded fasteners.

8. The flashlight mount of claim 7, wherein the extension is angled 45 degrees relative to the base.

9. The flashlight mount of claim 7, wherein the tapered head of each of the two threaded fasteners is complementary to the tapered inlet of each of the overlapping holes in the accessory interface.

10. The flashlight mount of claim 9, wherein the tapered head of each of the two threaded fasteners has a frustoconical shape.

11. The flashlight mount of claim 7, wherein the base and the extension are a single unitary piece.

* * * * *